US007866174B2

(12) United States Patent
Jung

(10) Patent No.: US 7,866,174 B2
(45) Date of Patent: Jan. 11, 2011

(54) REFRIGERATOR HAVING COLD AIR CIRCULATING APPARATUS AND CONTROL METHOD OF CIRCULATING COLD AIR

(75) Inventor: Hak Jae Jung, Seoul (KR)

(73) Assignee: Daewoo Electronics Corporation, Seoul (KR)

( * ) Notice: Subject to any disclaimer, the term of this patent is extended or adjusted under 35 U.S.C. 154(b) by 832 days.

(21) Appl. No.: 11/783,301

(22) Filed: Apr. 9, 2007

(65) Prior Publication Data

US 2008/0016889 A1 Jan. 24, 2008

(30) Foreign Application Priority Data

Jul. 21, 2006 (KR) ..... 10-2006-0068713

(51) Int. Cl.
*F25D 17/04* (2006.01)

(52) U.S. Cl. ..... 62/187; 62/186; 236/13

(58) Field of Classification Search ..... 62/187, 62/441, 186; 165/61; 236/13, 49.3; 454/258
See application file for complete search history.

(56) References Cited

U.S. PATENT DOCUMENTS 4,182,401 A * 1/1980 Pinnell et al. ..... 165/210
4,689,966 A 9/1987 Nonaka
6,327,867 B1 * 12/2001 Hyodo et al. ..... 62/187
7,051,549 B2 * 5/2006 Kim et al. ..... 62/441
2005/0022543 A1 * 2/2005 Shim ..... 62/186

FOREIGN PATENT DOCUMENTS

| | | |
|---|---|---|
| EP | 1 577 622 | 9/2005 |
| JP | 2000-258030 | 9/2000 |
| JP | 2006-010162 | 1/2006 |
| KR | 10-2004-0049596 | 6/2004 |

* cited by examiner

*Primary Examiner*—Cheryl J Tyler
*Assistant Examiner*—Jonathan Bradford
(74) *Attorney, Agent, or Firm*—Bacon & Thomas, PLLC

(57) ABSTRACT

A refrigerator having a cold air circulating apparatus includes: a main body, which is provided with a freezer compartment and a refrigerator compartment for preserving food items, and a temperature controlled compartment for preserving food items, separately from the freezer and the refrigerator compartments; a first cooling unit formed at the rear side of the freezer compartment for supplying cold air into the freezer compartment; a second cooling unit formed at the rear side of the refrigerator compartment for providing cold air into the refrigerator compartment; a cold air circulating device for circulating air inside the temperature controlled compartment by using the first cooling unit or the second cooling unit; and a control unit for controlling operations of the cold air circulating device to thereby regulate temperature inside the temperature controlled compartment, based on a user-set temperature for the temperature controlled compartment.

9 Claims, 6 Drawing Sheets

REFRIGERATOR HAVING COLD AIR CIRCULATING APPARATUS AND CONTROL METHOD OF CIRCULATING COLD AIR

FIELD OF THE INVENTION

The present invention relates to a cold air circulating apparatus of a refrigerator having a temperature controlled compartment and a control method thereof; and, more particularly, to a cold air circulating apparatus of a refrigerator having a temperature controlled compartment, wherein cold air circulation is performed by using cold air from a refrigerator compartment and a freezer compartment, and a control method thereof.

BACKGROUND OF THE INVENTION

In general, a refrigerator includes cooling cycle components such as a compressor, a condenser, an expansion valve, an evaporator, and the like. By using the cooling cycle components, cold air is generated to preserve food items in a fresh state for an extended period of time.

Such a refrigerator is structured in a manner that the inside of its main body which defines an outer appearance thereof, is partitioned into a refrigerator compartment and a freezer compartment to preserve food items in one of the compartments for refrigeration and freezing, respectively, depending on their preservation temperature.

Meanwhile, a modern refrigerator has a three-door structure such that, in addition to the traditional two storage spaces composed of a refrigerator compartment and a freezer compartment for preserving food items at predetermined fixed temperatures, there is provided with a temperature controlled compartment which is a separate storage space for preserving therein food items that need to be preserved at different temperatures from each other.

FIG. 1 illustrates a refrigerator having a conventional temperature controlled compartment.

As shown in FIG. 1, a refrigerator 10 includes a freezer compartment 20, a refrigerator compartment 30, and a temperature controlled compartment 40 which is a separate storage space disposed under the refrigerator compartment 30, wherein the freezer compartment 20, the refrigerator compartment 30, and the temperature controlled compartment 40 are partitioned by a partition wall 11.

The conventional refrigerator 10 is operated in such a way that the cold air supplied from an evaporator (not shown) built in a rear duct of the refrigerator 10 is blown into the freezer compartment 20 through a freezer compartment fan (not shown), and a part of the cold air supplied to the freezer compartment 20 is introduced to the refrigerator compartment 30. In the meantime, a part of the cold air cooling down the refrigerator compartment 30 through a refrigerator compartment fan (not shown) is introduced to the temperature controlled compartment 40 via a cold air inlet (not shown) which is formed at the lower portion of the refrigerator compartment 30.

However, in the conventional refrigerator where inside temperature thereof is cooled by the operation of an evaporator, the refrigerator is poor in cooling efficiency because the entire cooling cycle is required to be run to cool down the temperature controlled compartment 40 if the outside air is flowed into the inside of the temperature controlled compartment 40 while its door is open for use.

It is also difficult to maintain the temperature of the temperature controlled compartment 40 accurately at a specific value simply by regulating an amount of cold air supplied from the freezer compartment 20 or from the refrigerator compartment 30.

Moreover, there is another difficulty in temperature controlled between refrigeration and freezing, depending on the temperature controlled compartment's usage conditions set by a user.

In addition, although not shown in FIG. 1, if the freezer compartment 20, the refrigerator compartment 30 and the temperature controlled compartment 40 are cooled individually by their own cooling units such as evaporators or blower fans embedded in a rear side of the refrigerator, since the cooling units occupy too much space of the refrigerator, the space efficiency of the temperature controlled compartment 40 is reduced. As for the manufacturing process, if a cooling unit is assembled onto the rear side of the relatively small temperature controlled compartment 40, an assembly process becomes difficult and the number of assembly processes is increased, which gives rise to a number of inefficiencies such as an increase of complexity in manufacturing procedure of refrigerator, an increase of material and labor costs, and the like.

SUMMARY OF THE INVENTION

It is, therefore, an object of the present invention to provide a cold air circulating apparatus of a refrigerator capable of regulating temperature inside a temperature controlled compartment without having a separate cooling unit therefor by making use of cold air from freezer and refrigerator compartments based on a preset temperature of the temperature controlled compartment, and a control method thereof.

In accordance with one aspect of the present invention, there is provided a refrigerator having a cold air circulating apparatus, including:

a main body, which is provided with a freezer compartment and a refrigerator compartment for preserving food items, and a temperature controlled compartment for preserving food items, separately from the freezer and the refrigerator compartments;

a first cooling unit formed at the rear side of the freezer compartment for supplying cold air into the freezer compartment;

a second cooling unit formed at the rear side of the refrigerator compartment for providing cold air into the refrigerator compartment;

a cold air circulating device for circulating air inside the temperature controlled compartment by using the first cooling unit or the second cooling unit; and a control unit for controlling operations of the cold air circulating device to thereby regulate temperature inside the temperature controlled compartment, based on a user-set temperature for the temperature controlled compartment.

Preferably, the cold air circulating device includes a first cold air duct, installed between the first cooling unit and the temperature controlled compartment, for guiding the cold air from the first cooling unit to the temperature controlled compartment; a first damper, installed in the first cold air duct, for selectively introducing the cold air from the first cooling unit to the temperature controlled compartment under a control of the control unit; a second cold air duct, installed between the second cooling unit and the temperature controlled compartment, for guiding the cold air from the second cooling unit to the temperature controlled compartment; and a second damper, installed in the second cold air duct, for being opened or closed for selectively introducing the cold air from the second cooling unit to the temperature controlled compartment under a control of the control unit.

Preferably, the cold air circulating device further includes a first blower fan, installed between the first cooling unit and the first damper, for blowing the cold air from the first cooling unit into the temperature controlled compartment, under a control of the control unit; and a second blower fan, installed between the second cooling unit and the second damper, for blowing the cold air from the second cooling unit into the temperature controlled compartment, under a control of the control unit.

Preferably, each of the first and the second damper includes an electric-power damper. When the user-set temperature falls in a range of the temperature of the freezer compartment, the first damper opens while the second damper closes, and, when the user-set temperature falls in a range of the temperature of the refrigerator compartment, the second damper opens while the first damper closes.

Preferably, when the user-set temperature falls in a range of the temperature of the freezer compartment, the first blower fan is driven while the second blower fan is stopped, and, when the user-set temperature falls in a range of the temperature of the refrigerator compartment, the second blower fan is driven while the first blower fan is stopped.

Preferably, the cold air circulating device further includes a first return duct, formed between the freezer compartment and the temperature controlled compartment, for reintroducing the cold air passing through the first damper into the freezer compartment, under a control of the control unit; and a second return duct, formed between the refrigerator compartment and the temperature controlled compartment, for reintroducing the cold air passing through the second damper back into the refrigerator compartment, under a control of the control unit.

Preferably, a third damper is provided at the first return duct for selectively reintroducing the cold air from the temperature controlled compartment into the freezer compartment under control of the control unit, and a fourth damper is provided at the second return duct for selectively reintroducing the cold air from the temperature controlled compartment into the refrigerator compartment under control of the control unit.

Preferably, each of the third and the fourth damper is an electric-power damper. When the user-set temperature falls in a range of the temperature of the freezer compartment, the third damper opens while the fourth damper closes, and, when the user-set temperature falls in a range of the temperature of the refrigerator compartment, the fourth damper opens while the third damper closes.

In accordance another aspect of the present invention, there is provided a control method of circulating cold air produced in a refrigerator, wherein the refrigerator includes a freezer compartment, a refrigerator compartment and a temperature controlled compartment, the control method including:

(a) setting the user-set temperature for the temperature controlled compartment;

(b) comparing the user-set temperature with a temperature in the freezer compartment and a temperature in the refrigerator compartment; and (c) flowing the cold air into the temperature controlled compartment from the freezer or refrigerator compartment, based on a comparison result of said step (b).

Preferably, in said step (c), if the user-set temperature falls in a range of the temperature in the freezer compartment, introducing the cold air in the freezer compartment into the temperature compartment by blowing the cold air into the temperature controlled compartment; and reintroducing the cold air circulated in the temperature controlled compartment into the freezer compartment.

Preferably, in said step (c), if the user-set temperature falls in a range of the temperature in the refrigerator compartment, introducing the cold air in the refrigerator compartment into the temperature compartment by blowing the cold air into the temperature controlled compartment; and reintroducing the cold air circulated in the temperature controlled compartment into the refrigerator compartment.

BRIEF DESCRIPTION OF THE DRAWINGS

The above and other objects and features of the present invention will become apparent from the following description of embodiments, given in conjunction with the accompanying drawings, in which.

DETAILED DESCRIPTION OF THE EMBODIMENT

Hereinafter, embodiments of the present invention will be described in detail with reference to the accompanying drawings.

Figure 1:
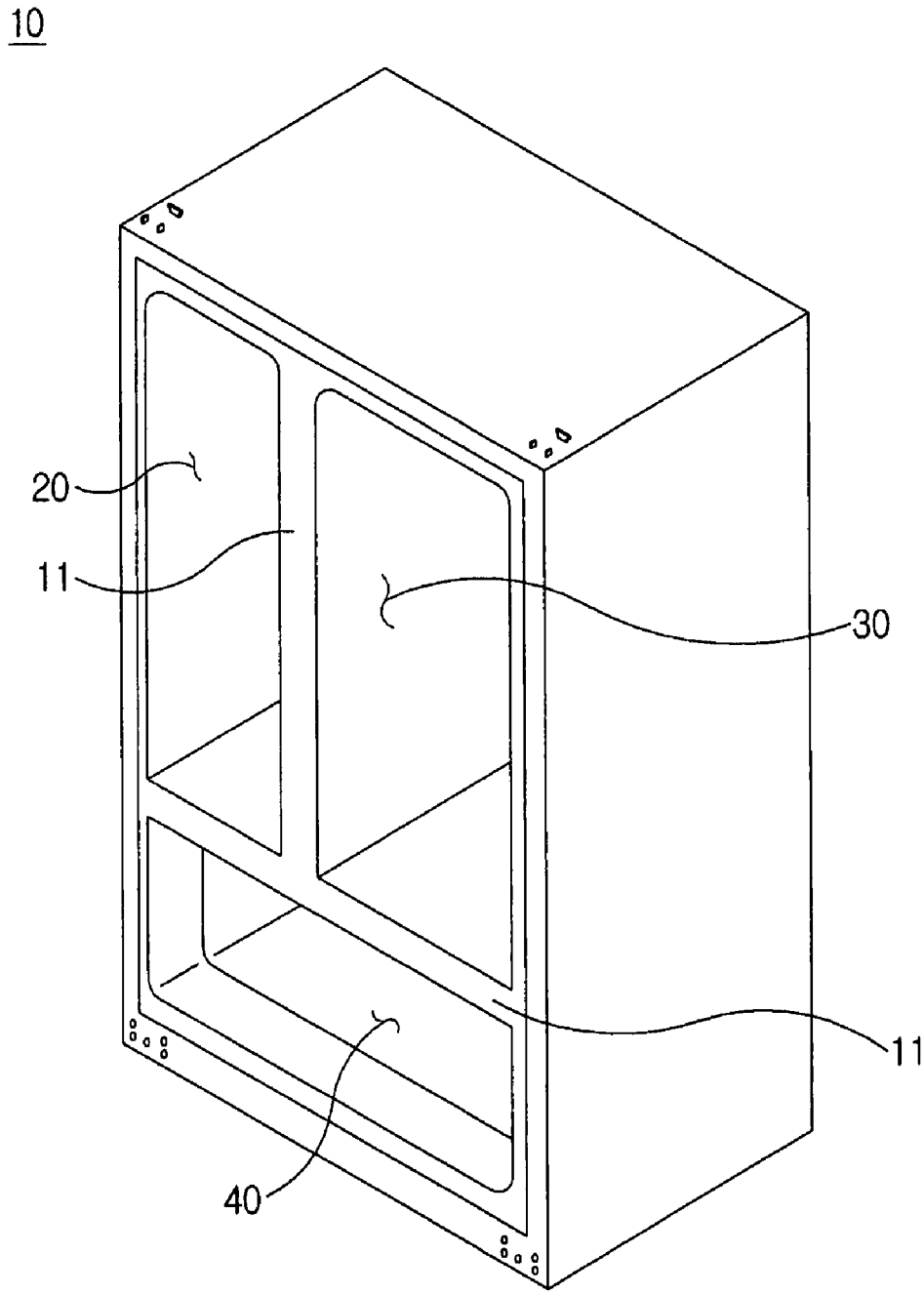
FIG. 1 (PRIOR ART)
FIG. 1 is a perspective view showing an interior of a conventional refrigerator.
Figure 2:
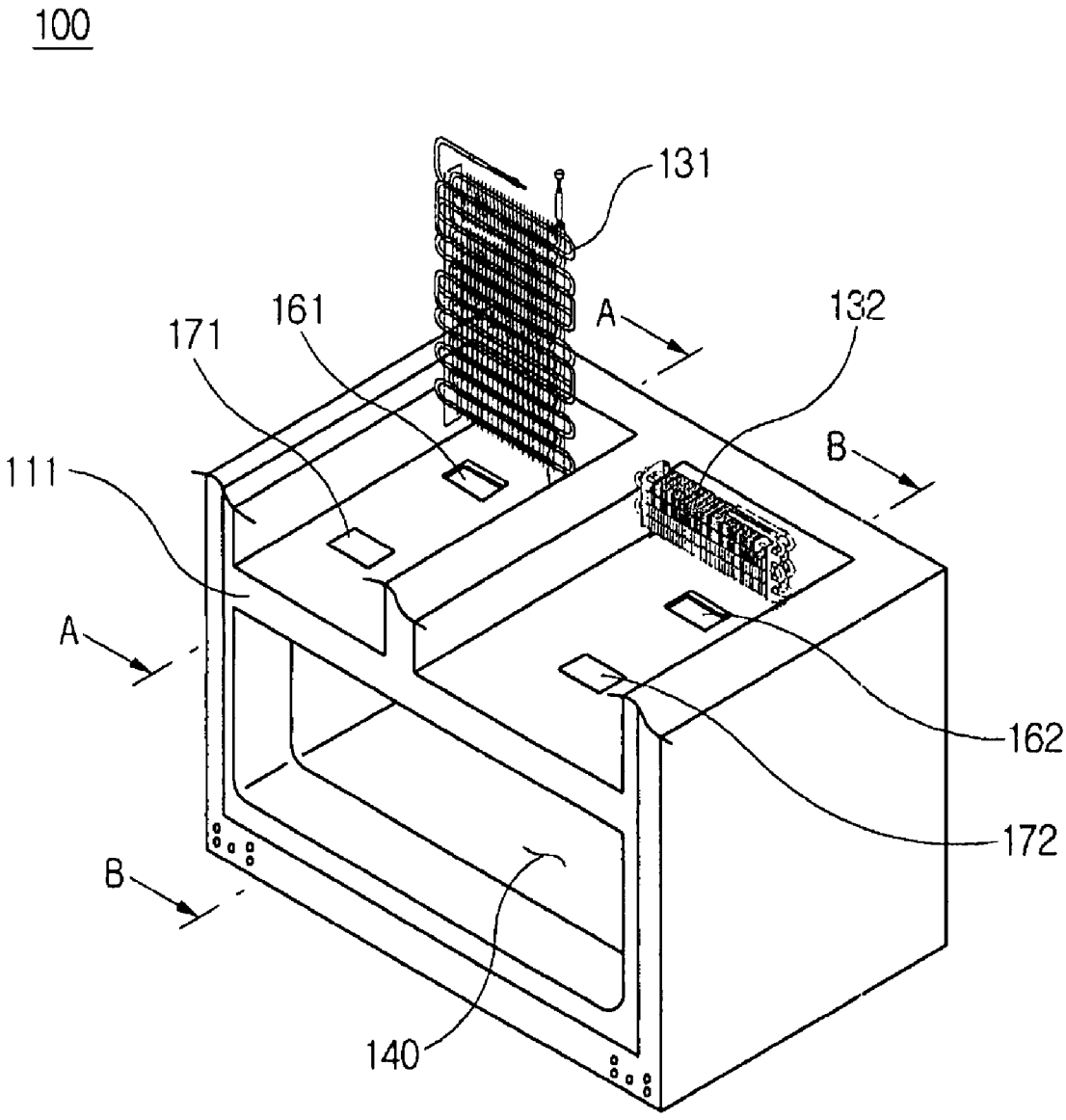
FIG. 2 illustrates a partial perspective view of a temperature controlled compartment, provided thereon dampers and return ducts, in a refrigerator in accordance with the present invention.
Figure 3:
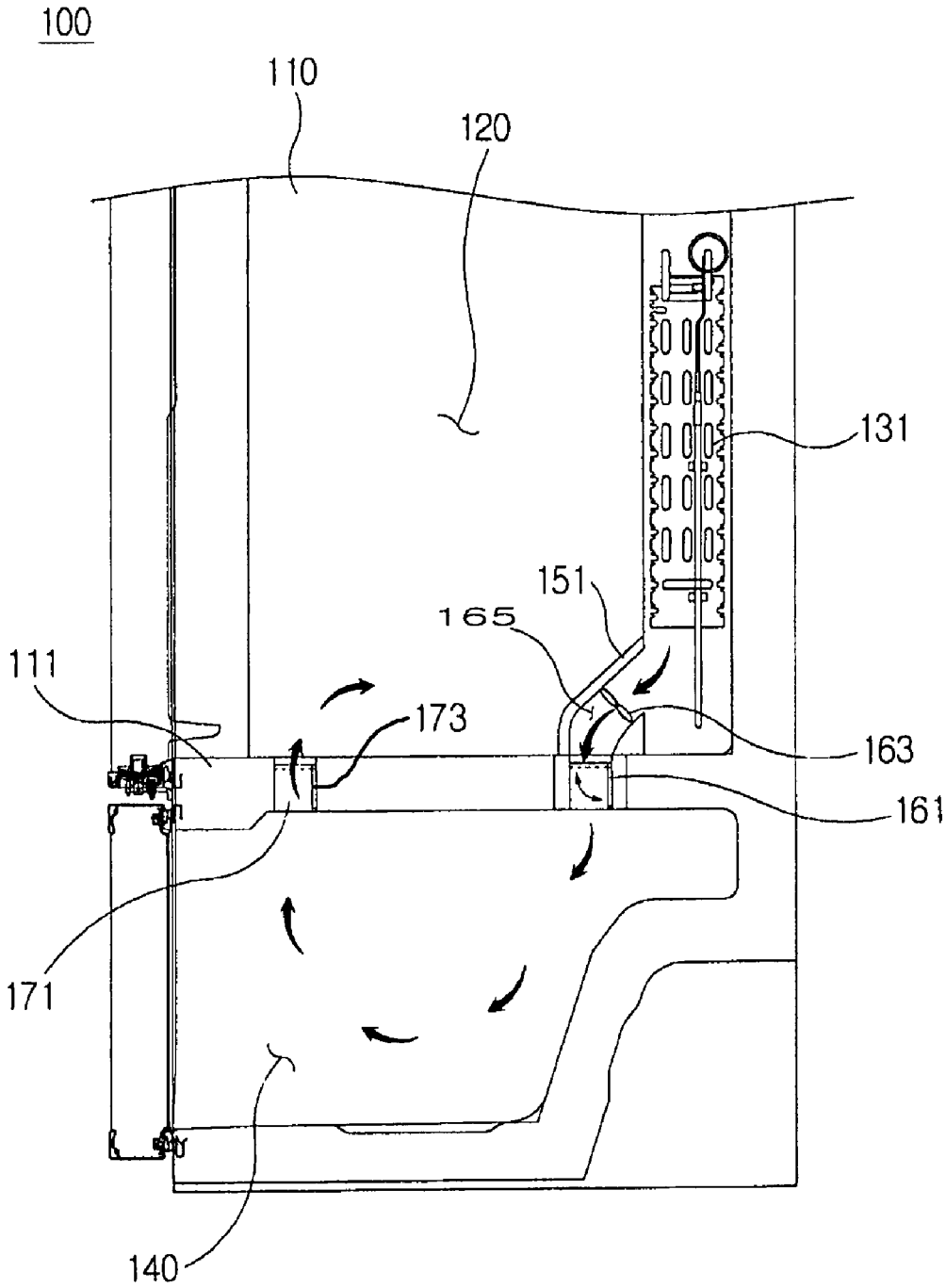
FIG. 3 is a cross-sectional view taken along line A-A of FIG. 2, showing a partial horizontal cross-sectional view of interior of a freezer compartment and a temperature controlled compartment partitioned therefrom.

FIG. 2 is a partial perspective view showing a temperature controlled compartment, provided thereon dampers and return ducts, in a refrigerator in accordance with the present invention, and FIG. 3 is a cross-sectional view taken along line A-A of FIG. 2, showing a partial horizontal cross-sectional view of interior of a freezer compartment and a temperature controlled compartment partitioned therefrom.

Figure 4:
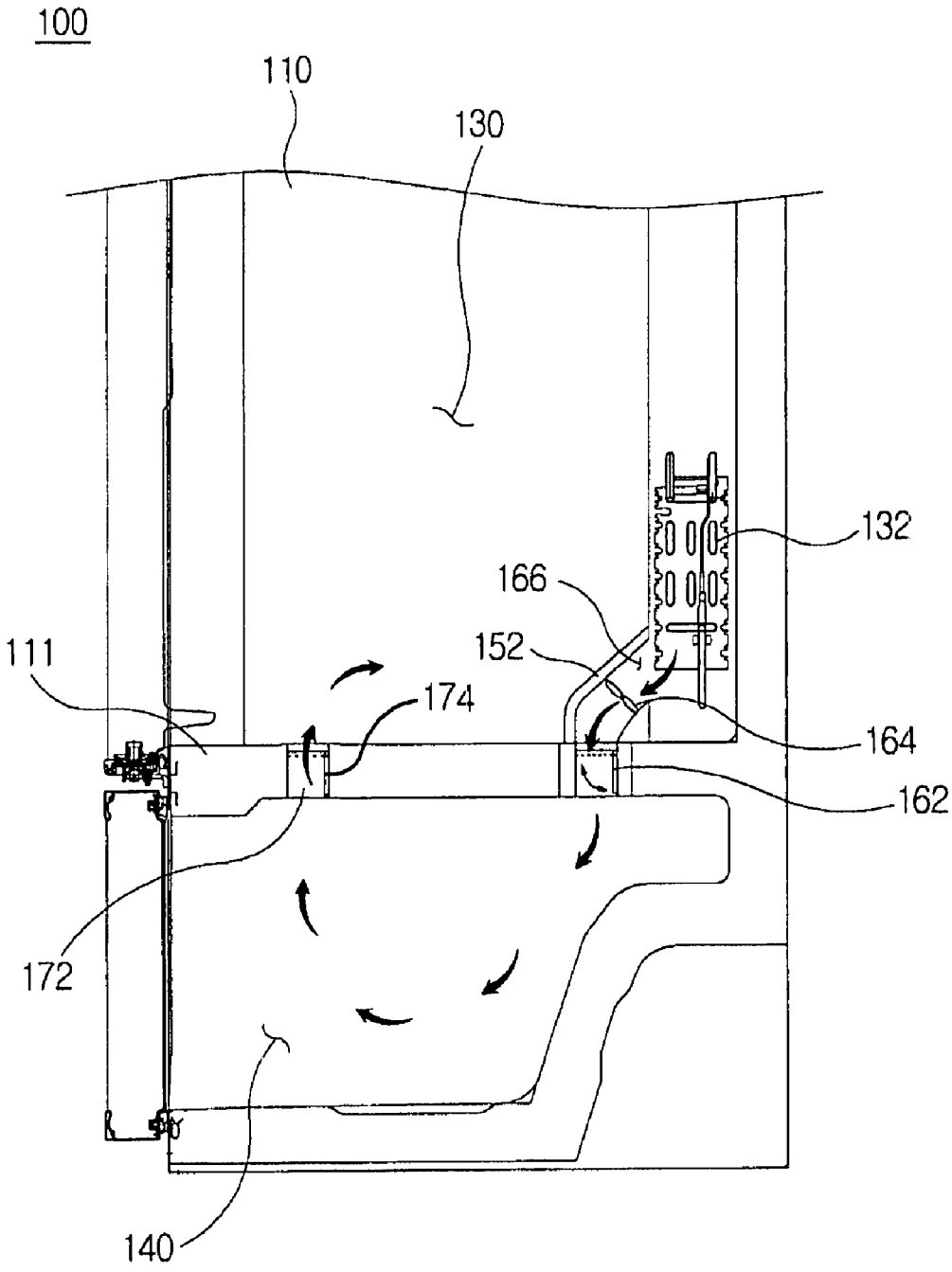
FIG. 4 is a cross-sectional view taken along line B-B of FIG. 2, showing a partial horizontal cross-sectional view of interior of a refrigerator compartment and a temperature controlled compartment partitioned therefrom.

FIG. 4 is a cross-sectional view taken along line B-B of FIG. 2, showing a partial horizontal cross-sectional view of interior of a refrigerator compartment and a temperature controlled compartment partitioned therefrom.

In the following description, only new components are designated by new reference numerals, and the same components as those of the conventional refrigerator or like components are designated by the same reference numerals, so the explanation of those same components will be omitted hereafter.

As shown in the drawings, a main body 10 of a refrigerator 100 in accordance with the present invention includes three storage compartments such as a freezer compartment 120, a refrigerator compartment 130, and a temperature controlled compartment 140. The freezer compartment 120, the refrigerator compartment 130, and the temperature controlled compartment 140 are partitioned by a partition wall 111 and each of them has a door for its opening/closing. In general, the temperature controlled compartment 140 is built in a slidable drawer form.

Each of the freezer compartment 120 and the refrigerator compartment 130 has a cooling unit, formed at its rear side, for generating cold air to lower its temperature. Further, a cold air circulating device is installed on the partition wall 111 partitioning the temperature controlled compartment 140 to flow cold air from each cooling unit into the temperature controlled compartment 140.

Meanwhile, temperature of the temperature controlled compartment 140 is set by a user, depending on kind of food items to be stored therein. In order to maintain the temperature of the temperature controlled compartment 40 to be a user-set temperature for the temperature controlled compartment 140, there is provided a control unit 180 for controlling the cold air circulating device. For instance, in case where food items require freezer storage, a control unit 180 controls the cold air circulating device to flow cold air from the freezer compartment 120 into the temperature controlled compartment 140 based on the user-set temperature. Meanwhile, in case where food items require refrigerator storage, the control unit 180 controls the cold air circulating device to flow cold air from the refrigerator compartment 130 into the temperature controlled compartment 140 based on the user-set temperature.

The cooling unit for producing cold air to be supplied to the freezer compartment 120 (hereinafter, referred to as a first cooling unit) has an evaporator 131, provided in a duct disposed at the rear side of the freezer compartment 120, and a blower fan (not shown), wherein the cold air produced by the first cooling unit is blown into the freezer compartment 120.

On a part of the partition wall 111, the part partitioning the temperature controlled compartment 140 and the freezer compartment 120 (hereinafter, referred to as a first part of the partition wall 111), there is provided a first damper 161 serving as a cold air inlet, being opened or closed to introduce cold air from the freezer compartment 120 thereto, depending on the user-set temperature for the temperature controlled compartment 140.

Between the first damper 161 and the rear duct of the freezer compartment 120, a first cold air duct 151 serving as a passage 165 of cold air from the freezer compartment 120 is formed, and on the passage 165, a first blower fan 163 is formed.

On the other hand, the cooling unit for producing cold air to be supplied to the refrigerator compartment 130 (hereinafter, referred to as a second cooling unit) has an evaporator 132, provided in a duct disposed at the rear side of the refrigerator compartment 130, and a blower fan (not shown), wherein cold air produced by the second cooling unit is blown into the refrigerator compartment 130.

On a part of the partition wall 111, the part partitioning the temperature controlled compartment 140 and the refrigerator compartment 130 (hereinafter, referred to as a second part of the partition wall 11), there is provided a second damper 162 serving as a cold air inlet, being opened or closed to introduce cold air from the refrigerator compartment 130 thereto, based on the user-set temperature for the temperature controlled compartment 140.

Between the second damper 162 and the rear duct of the refrigerator compartment 130, a second cold air duct 152 serving as a passage 166 of cold air from the refrigerator compartment 130 is formed, and on the passage 166, a second blower fan 164 is formed.

Further, on the first and the second part of the partitioning wall 111, a first return duct 171 and a second return duct 172 for introducing cold air into the freezer compartment 120 and the refrigerator compartment 130, respectively, are formed in front of the first damper 161 and the second damper 162. Therefore, cold air flowed through the first or the second dampers 161 and 162 circulates the temperature controlled compartment 140 and then returns to the freezer compartment 120 or the refrigerator compartment 130 through the corresponding return duct 171 or 172.

A third and a fourth damper 173 and 174 are provided at the first and the second return duct 171 and 172, respectively, so that the cold air can be selectively reintroduced into either the freezer compartment 120 or the refrigerator compartment 130.

Figure 5:
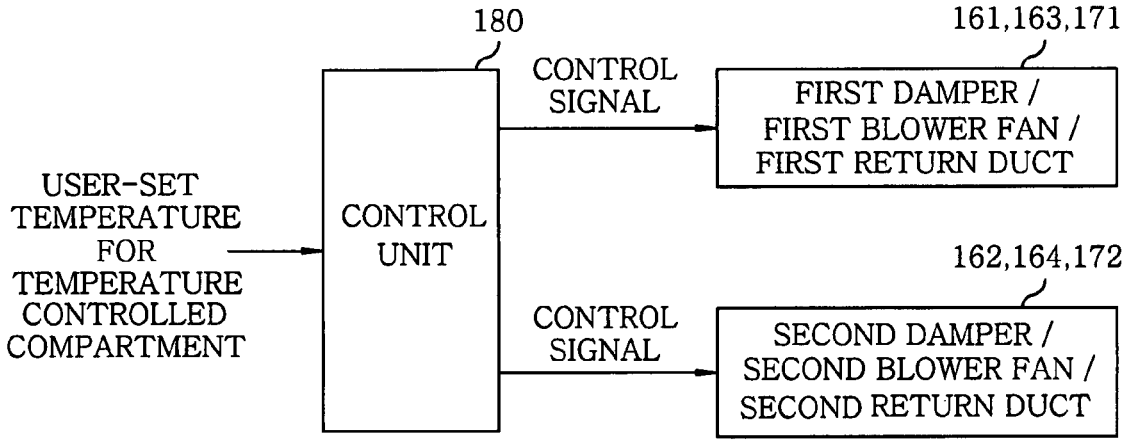
FIG. 5 illustrates a block diagram of a cold air circulating apparatus of a refrigerator in accordance with the present invention.

FIG. 5 illustrates a block diagram of a cold air circulating apparatus of a refrigerator in accordance with the present invention. As shown in FIG. 5, The first damper 161, the first blower fan 163, the second damper 162, the second blower fan 164, the first return duct 171, and the second return duct 174 are controlled by the control unit 180 which generates a control signal to drive each of these components depending on the user-set temperature for the temperature controlled compartment 140.

Preferably, electric-power dampers are employed as the first, the second, the third and the fourth damper 161, 162, 173 and 174, so that the open/close status thereof can be controlled by the control unit 180. In general, it is preferable that drive motors (not shown), for opening/closing each of the dampers 161, 162, 173 and 174 are installed, and controlled by the control unit.

Below, a method for controlling cold air inflow to the temperature controlled compartment 140 in the cold air circulating apparatus of a refrigerator having the temperature controlled compartment 140 in accordance with the present invention will be described in detail.

Figure 6:
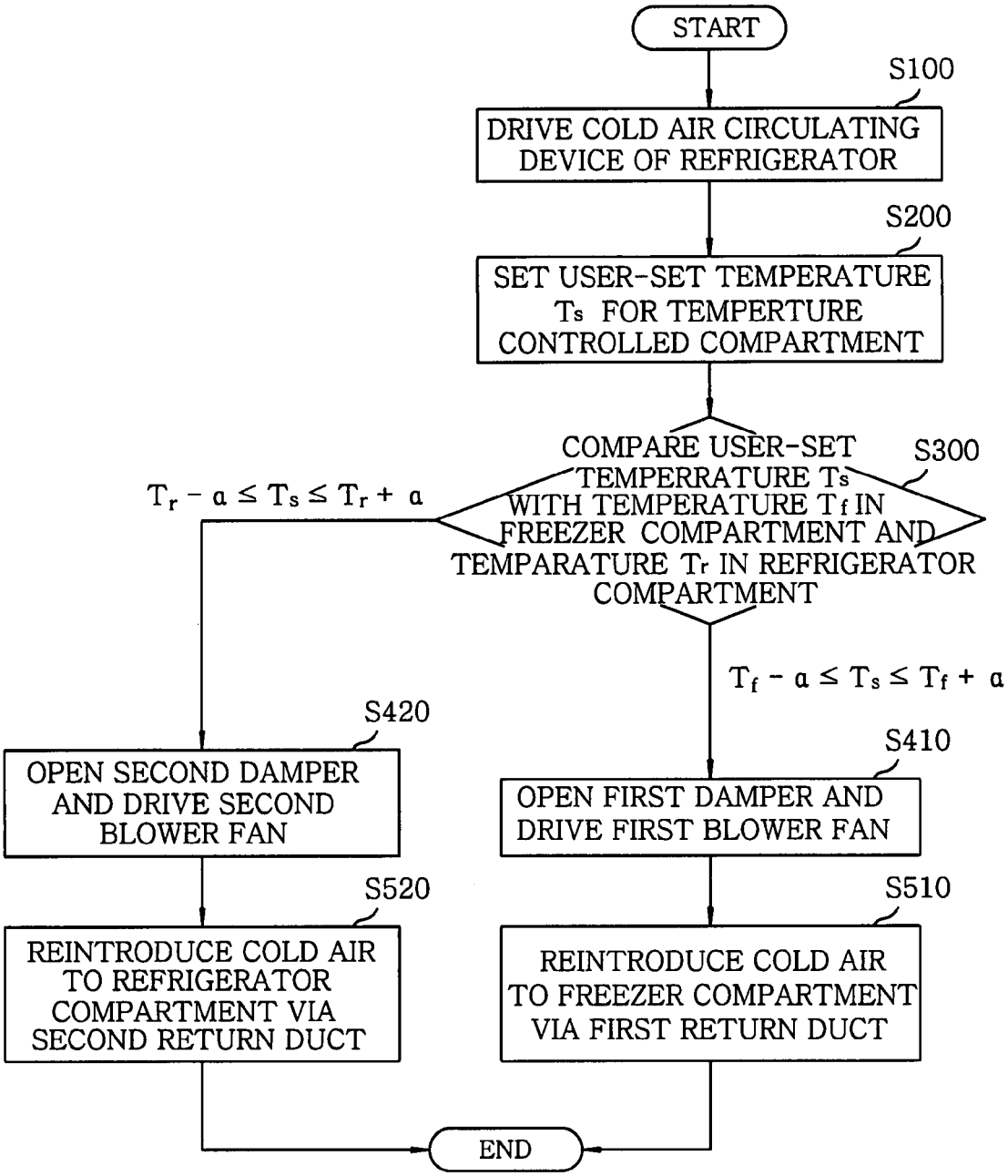
FIG. 6 provides a flowchart for describing a cold air circulating mechanism of a temperature controlled compartment in a refrigerator in accordance with the present invention.

FIG. 6 provides a flowchart for describing a cold air circulating mechanism of a temperature controlled compartment in a refrigerator in accordance with the present invention.

First, by forcibly driving the blower fan (not shown) installed in each of the cooling units for the freezer and refrigerator compartments 120 and 130 or by applying power to the cooling unit, the cooling unit provided in each of the freezer and refrigerator compartments 120 and 130 of the refrigerator is driven (S100).

After that, the user sets temperature for the temperature controlled compartment 140, depending on the type of food items to be preserved in the temperature controlled compartment 140 (S200).

Based on the user-set temperature $T_s$, it is determined whether to introduce cold air from the first cooling unit or from the second cooling unit (S300). That is, it is determined whether the user-set temperature $T_s$ falls in a temperature range requiring freezer storage or a temperature range requiring refrigerator storage.

To be specific, it is determined whether the user-set temperature $T_s$ is within a certain deviation ($\pm\alpha°$) from temperature $T_f$ or $T_r$ of the freezer compartment 120 or the refrigerator compartment 130.

Based on a result of the above-described determining process, the control unit 180 generates a control signal to flow cooled air from the cooling unit of the freezer compartment 120 or the refrigerator compartment 130, through the passage 165 or 166 of the first or second cold air duct 151 or 152, into the temperature controlled compartment 140 via the first or second damper 161 or 162 (S410 or S420).

If the user-set temperature $T_s$ falls in a range from $T_f-\alpha$ to $T_f+\alpha$ (here, $\alpha$ is about 3), the control unit 180 controls, in the step S410, the first damper 161 to open while the second damper 162 to close, thereby introducing the cooled air from the first cooling unit of the freezer compartment 120 through the first damper 161. Further, the control unit 180 drives the first blower fan 163, provided in the passage 165 between the first cold air duct 151 and the first damper 161, to blow the cooled air into the temperature controlled compartment 140.

Subsequently, after the temperature controlled compartment 140 is cooled down by the cold air from the first cooling unit, the circulated cold air flows back into the freezer compartment 120 through the first return duct 171 formed on the partition wall 111 (S510). To be specific, the control unit 180 opens the third damper 173 and closes the fourth damper 174.

On the other hand, if the user-set temperature $T_s$ falls in a range from $T_r-\alpha$ to $T_r+\alpha$ (here, $\alpha$ is about 3), the control unit 180 controls, in the step S420, the second damper 162 to open while the first damper 161 to close, thereby introducing the cooled air from the second cooling unit of the refrigerator compartment 130 through the second damper 162. Further, the control unit 180 drives the second blower fan 164, provided in the passage 166 between the second cold air duct 152 and the second damper 162, to blow the cooled air into the temperature controlled compartment 140.

Subsequently, after the temperature controlled compartment 140 is cooled down by the cold air from the second cooling unit, the circulated cold air flows back into the refrigerator compartment 130 through the second return duct 172 formed on the partition wall 111 (S520). To be specific, the control unit 180 opens the fourth damper 174 and closes the third damper 173.

By controlling the cold air circulating apparatus of the temperature controlled compartment 140 in this manner, it becomes easy to regulate temperature according to the type of food items to be preserved in the temperature controlled compartment 140. Further, the assembly process of the temperature controlled compartment 140 during the production of refrigerator is easy because it is no longer required to install a separate cooling unit at the rear side of the temperature controlled compartment 140 that is relatively low in height and very deep.

As described above, according to the present invention, cold air from the freezer compartment or from the refrigerator compartment is introduced and circulated in the temperature controlled compartment, depending on a user-set temperature for the temperature controlled compartment, whereby the cooling efficiency of the refrigerator can be increased while power consumption can be substantially reduced.

Moreover, since a separate cooling unit is no longer required for the temperature controlled compartment, the entire space of the temperature controlled compartment is now available for food storage.

Furthermore, temperature inside the temperature controlled compartment can be switched to refrigeration or freezer storage by user-set temperatures, and thus, food items can be preserved very efficiently depending on their types.

While the invention has been shown and described with respect to the embodiments, it will be understood by those skilled in the art that various changes and modification may be made without departing from the scope of the invention as defined in the following claims.

What is claimed is:

1. A refrigerator having a cold air circulating apparatus, comprising:

a main body, which is provided with a freezer compartment and a refrigerator compartment for preserving food items, and a temperature controlled compartment for preserving food items, separately from the freezer and the refrigerator compartments;

a first cooling unit formed at the rear side of the freezer compartment for supplying cold air into the freezer compartment;

a second cooling unit formed at the rear side of the refrigerator compartment for providing cold air into the refrigerator compartment;

a cold air circulating device for circulating air inside the temperature controlled compartment by using the first cooling unit or the second cooling unit; and a control unit for controlling operations of the cold air circulating device to thereby regulate temperature inside the temperature controlled compartment, based on a user-set temperature for the temperature controlled compartment, wherein the cold air circulating device includes:

a first cold air duct, installed between the first cooling unit and the temperature controlled compartment, for guiding the cold air from the first cooling unit to the temperature controlled compartment;

a first damper, installed in the first cold air duct, for selectively introducing the cold air from the first cooling unit to the temperature controlled compartment under a control of the control unit;

a second cold air duct, installed between the second cooling unit and the temperature controlled compartment, for guiding the cold air from the second cooling unit to the temperature controlled compartment; and a second damper, installed in the second cold air duct, for being opened or closed for selectively introducing the cold air from the second cooling unit to the temperature controlled compartment under a control of the control unit.

2. The refrigerator of claim 1, wherein the cold air circulating device further includes:

a first blower fan, installed between the first cooling unit and the first damper, for blowing the cold air from the first cooling unit into the temperature controlled compartment, under a control of the control unit; and a second blower fan, installed between the second cooling unit and the second damper, for blowing the cold air from the second cooling unit into the temperature controlled compartment, under a control of the control unit.

3. The refrigerator of claim 2, wherein when the user-set temperature falls in a range of the temperature of the freezer compartment, the first blower fan is driven while the second blower fan is stopped, and, when the user-set temperature falls in a range of the temperature of the refrigerator compartment, the second blower fan is driven while the first blower fan is stopped.

4. The refrigerator of claim 1, wherein each of the first and the second damper includes an electric-power damper, and wherein, when the user-set temperature falls in a range of the temperature of the freezer compartment, the first damper opens while the second damper closes, and, when the user-set temperature falls in a range of the temperature of the refrigerator compartment, the second damper opens while the first damper closes.

5. The refrigerator of claim 1, wherein the cold air circulating device further includes:

a first return duct, formed between the freezer compartment and the temperature controlled compartment, for selectively reintroducing the cold air passing through the first damper into the freezer compartment, under a control of the control unit; and a second return duct, formed between the refrigerator compartment and the temperature controlled compartment, for selectively reintroducing the cold air passing through the second damper back into the refrigerator compartment, under a control of the control unit.

6. The refrigerator of claim 5, wherein a third damper is provided at the first return duct for selectively reintroducing the cold air from the temperature controlled compartment into the freezer compartment under control of the control unit, and wherein a fourth damper is provided at the second return duct for selectively reintroducing the cold air from the temperature controlled compartment into the refrigerator compartment under control of the control unit.

7. The refrigerator of claim 6, wherein each of the third and the fourth damper is an electric-power damper, and wherein, when the user-set temperature falls in a range of the temperature of the freezer compartment, the third damper opens while the fourth damper closes, and, when the user-set temperature falls in a range of the temperature of the refrigerator compartment, the fourth damper opens while the third damper closes.

8. A control method of circulating cold air produced in a refrigerator, wherein the refrigerator includes a freezer compartment, a refrigerator compartment and a temperature controlled compartment, the control method comprising:

(a) setting the user-set temperature for the temperature controlled compartment;

(b) comparing the user-set temperature with a temperature in the freezer compartment and a temperature in the refrigerator compartment; and (c) flowing the cold air into the temperature controlled compartment from the freezer or refrigerator compartment, based on a comparison result of said step (b) wherein, if the user-set temperature falls in a range of the temperature in the freezer compartment, introducing the cold air in the freezer compartment into the temperature compartment by blowing the cold air into the temperature controlled compartment; and reintroducing the cold air circulated in the temperature controlled compartment into the freezer compartment.

9. A control method of circulating cold air produced in a refrigerator, wherein the refrigerator includes a freezer compartment, a refrigerator compartment and a temperature controlled compartment, the control method comprising:

(a) setting the user-set temperature for the temperature controlled compartment;

(b) comparing the user-set temperature with a temperature in the freezer compartment and a temperature in the refrigerator compartment; and (c) flowing the cold air into the temperature controlled compartment from the freezer or refrigerator compartment, based on a comparison result of said step (b) wherein, if the user-set temperature falls in a range of the temperature in the refrigerator compartment, introducing the cold air in the refrigerator compartment into the temperature compartment by blowing the cold air into the temperature controlled compartment; and reintroducing the cold air circulated in the temperature controlled compartment into the refrigerator compartment.

* * * * *